US007652639B2

(12) United States Patent
Lee

(10) Patent No.: US 7,652,639 B2
(45) Date of Patent: Jan. 26, 2010

(54) DRIVING METHOD OF PLASMA DISPLAY PANEL AND PLASMA DISPLAY

(75) Inventor: Joo-Yul Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 552 days.

(21) Appl. No.: 11/101,593

(22) Filed: Apr. 8, 2005

(65) Prior Publication Data

US 2005/0225505 A1 Oct. 13, 2005

(30) Foreign Application Priority Data

Apr. 12, 2004 (KR) ..... 10-2004-0024868

(51) Int. Cl.
*G09G 3/28* (2006.01)

(52) U.S. Cl. ..... 345/60; 345/63; 315/169.4

(58) Field of Classification Search ..... 345/204, 345/690, 41–42, 60–72; 315/169.4
See application file for complete search history.

(56) References Cited

U.S. PATENT DOCUMENTS

| | | | | |
|---|---|---|---|---|
| 5,745,086 | A | 4/1998 | Weber | 345/63 |
| 6,710,550 | B2 | 3/2004 | Bang | |
| 6,784,858 | B2 * | 8/2004 | Awamoto | 345/60 |
| 7,079,088 | B2 * | 7/2006 | Koo et al. | 345/60 |
| 7,355,564 | B2 * | 4/2008 | Kang et al. | 345/60 |
| 7,365,709 | B2 * | 4/2008 | Kim et al. | 345/60 |
| 7,365,710 | B2 * | 4/2008 | Chung et al. | 345/60 |
| 7,453,421 | B2 * | 11/2008 | Kang et al. | 345/60 |
| 7,492,331 | B2 * | 2/2009 | Chae et al. | 345/60 |
| 7,564,428 | B2 * | 7/2009 | Chung et al. | 345/60 |
| 2003/0107532 | A1 * | 6/2003 | Choi | 345/60 |
| 2003/0117384 | A1 * | 6/2003 | Lee et al. | 345/204 |
| 2004/0021622 | A1 * | 2/2004 | Nagao et al. | 345/60 |
| 2004/0227701 | A1 * | 11/2004 | Chung et al. | 345/60 |
| 2005/0024294 | A1 * | 2/2005 | Kim et al. | 345/60 |
| 2005/0030260 | A1 * | 2/2005 | Kim et al. | 345/60 |
| 2005/0040770 | A1 * | 2/2005 | Kang et al. | 315/169.4 |
| 2005/0073480 | A1 * | 4/2005 | Kim et al. | 345/60 |
| 2005/0083259 | A1 * | 4/2005 | Kim et al. | 345/60 |
| 2005/0200566 | A1 * | 9/2005 | Kim et al. | 345/60 |
| 2006/0164336 | A1 * | 7/2006 | Yang et al. | 345/60 |

FOREIGN PATENT DOCUMENTS

| | | |
|---|---|---|
| CN | 1410960 A | 4/2003 |
| JP | 10-268831 | 10/1998 |
| JP | 2000-122601 | 4/2000 |
| JP | 2002-196720 | 7/2002 |

* cited by examiner

*Primary Examiner*—Alexander Eisen
*Assistant Examiner*—Jason M Mandeville
(74) *Attorney, Agent, or Firm*—H.C. Park & Associates, PLC

(57) ABSTRACT

An operation of reducing a voltage at a scan electrode by as much as a predetermined voltage and floating the scan electrode is repeatedly performed in a reset period of a plasma display panel. When the voltage at the scan electrode is reduced and a discharge is generated, a discharge extinction is generated when the scan electrode is floated, and the voltage at the scan electrode increases. At this time, the voltage increase of the scan electrode is applied and the voltage at the scan electrode is greatly reduced when the voltage at the scan electrode is subsequently reduced.

8 Claims, 7 Drawing Sheets

DRIVING METHOD OF PLASMA DISPLAY PANEL AND PLASMA DISPLAY

CROSS REFERENCE TO RELATED APPLICATION

This application claims priority to and the benefit of Korean Patent Application No. 10-2004-0024868, filed on Apr. 12, 2004, the entire content of which is incorporated herein by reference.

BACKGROUND OF THE INVENTION

1. Field of the Invention

The present invention relates to a method for driving a plasma display panel, and a plasma display. More specifically, the present invention relates to a driving circuit that applies a rising waveform and a falling waveform to electrodes of the plasma display panel, and a method thereof.

2. Discussion of the Background

Generally, the plasma display panel (PDP) is a flat panel display that shows characters or images using plasma generated by gas discharge, and it may include more than hundreds of thousands to millions of pixels arranged in a matrix, depending upon the PDP's size. The PDP may be a direct current (DC) PDP or an alternating current (AC) PDP according to an applied driving voltage waveform and discharge cell structure.

A conventional AC PDP driving method comprises sequentially performing a reset period, an address period, and a sustain period.

In the reset period, wall charges formed by a previous sustain discharge are eliminated, and cells are initialized for proper addressing. In the address period, an address voltage is applied to cells that are to be turned on (addressed cells), which accumulates wall charges in those addressed cells. In the sustain period, a sustain discharge waveform may be alternately applied to a scan electrode and a sustain electrode, thereby generating sustain discharges in the addressed cells to display images on the PDP.

U.S. Pat. No. 5,745,086 discloses a ramp waveform that may be applied to a scan electrode to establish wall charges. More specifically, a gradually rising ramp waveform and a gradually falling ramp waveform may be applied to the scan electrode. However, wall charges may not be precisely controlled in a given period of time because control precision depends on the slope of the ramp waveform.

SUMMARY OF THE INVENTION

The present invention provides a driving apparatus for controlling wall charges to be a desired state for a predetermined time, and a method thereof.

According to exemplary embodiments of the present invention, a voltage at an electrode may be repeatedly changed and floated.

Additional features of the invention will be set forth in the description which follows, and in part will be apparent from the description, or may be learned by practice of the invention.

The present invention discloses a plasma display including a panel in which a capacitance load is formed by at least two electrodes and a driver for applying a driving waveform to a first electrode of the capacitance load. The driver includes a transistor for forming a current path between the first electrode and a first power supplying a first voltage when the transistor turns on, a capacitor coupled between a gate and a drain of the transistor, and a first resistor coupled to a gate of the transistor. A control signal power source applies a control signal having a first level for turning on the transistor and a second level for turning off the transistor to the gate of the transistor through the first resistor.

The present invention also discloses a method for driving a plasma display panel in which a capacitance load is formed by at least two electrodes. In the method, a voltage at a first electrode of the capacitance load is changed by a first voltage, the first electrode is floated, and the voltage at the first electrode is changed by a second voltage. The second voltage depends upon whether the voltage at the first electrode changes when the first electrode is floated.

The present invention also discloses a plasma display including a panel in which a capacitance load is formed by at least two electrodes and a driver for applying a driving waveform to a first electrode of the capacitance load. The driver includes a transistor forming a current path between the first electrode and a first power for supplying a first voltage when turned on, the transistor being turned on in response to a first level of a control signal. A voltage compensator controls the transistor, when the transistor is turned off and the voltage at the first electrode is changed, in order to steeply change the voltage at the first electrode by as much as a changed voltage at the first electrode when the transistor is turned on. The control signal alternately has the first level and a second level, and the transistor turns off in response to the second level.

It is to be understood that both the foregoing general description and the following detailed description are exemplary and explanatory and are intended to provide further explanation of the invention as claimed.

BRIEF DESCRIPTION OF THE DRAWINGS

The accompanying drawings illustrate exemplary embodiments of the present invention, and, together with the description, serve to explain the principles of the invention.

DETAILED DESCRIPTION OF THE ILLUSTRATED EMBODIMENTS

Figure 1:
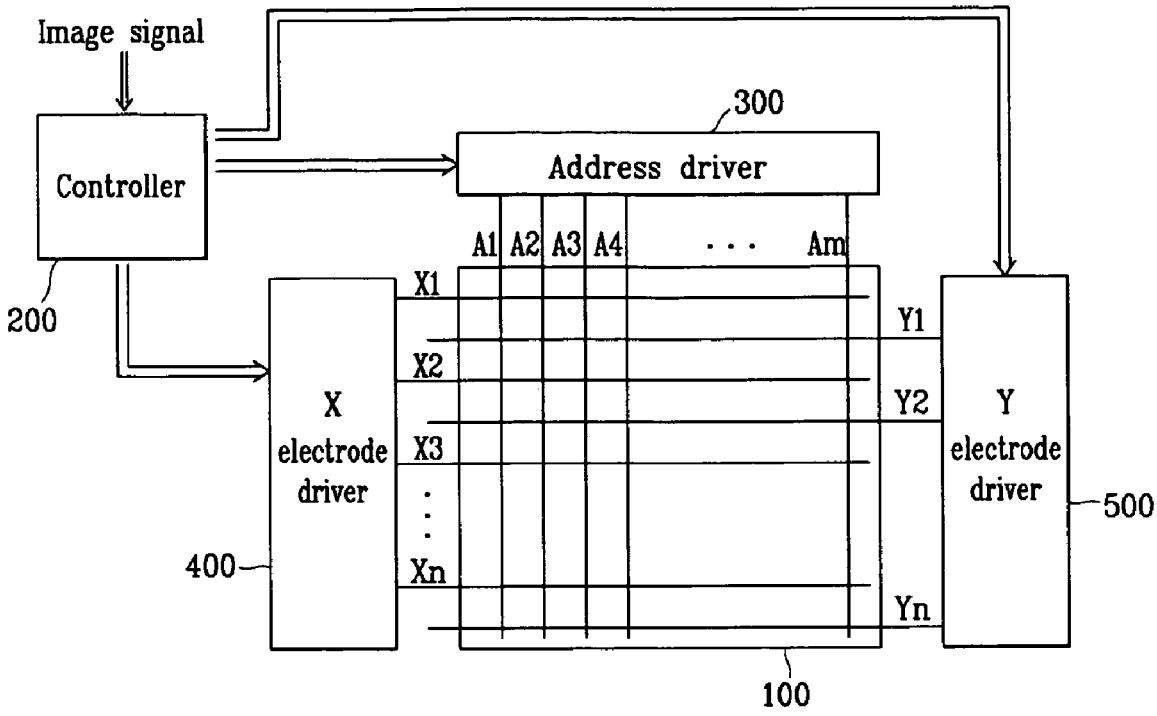
FIG. 1 is a diagram showing a plasma display according to exemplary embodiments of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

There may be parts shown in the drawings, or parts not shown in the drawings, that are not discussed in the specification as they are not essential to a complete understanding of the invention. Like reference numerals designate like elements. Phrases such as "one thing is coupled to another" can refer to either "a first one is directly coupled to a second one" or "the first one is electrically coupled to the second one with a third one provided therebetween". Further, "erase," "erasing," and "erased" do not require removal of all traces of the thing being erased.

The wall charges in the present invention indicate charges formed on a wall (e.g. dielectric layer) of discharge cells neighboring to each electrode and accumulated to electrodes. Although the wall charges do not actually touch the electrodes, it will be described that the wall charges are "generated," "formed," or "accumulated" thereon. Also, a wall voltage represents a potential difference formed on the wall of the discharge cells by the wall charges.

Exemplary embodiments of the present invention will now be described in detail with reference to the annexed drawings.

FIG. 1 is a diagram showing a plasma display according to exemplary embodiments of the present invention.

As shown in FIG. 1, the plasma display may include a plasma display panel 100, a controller 200, an address driver 300, a sustain (X) electrode driver 400, and a scan (Y) electrode driver 500.

The plasma display panel 100 includes a plurality of address electrodes $A_1$ to $A_m$ extending in the column direction, and a plurality of sustain electrodes $X_1$ to $X_n$ and scan electrodes $Y_1$ to $Y_n$ extending in the row direction. The sustain electrodes $X_1$ to $X_n$ are formed corresponding to the scan electrodes $Y_1$ to $Y_n$, and the sustain electrode terminals may be coupled together in common. The sustain electrodes $X_1$ to $X_n$ and the scan electrodes $Y_1$ to $Y_n$ are arranged on a first substrate, and the address electrodes $A_1$ to $A_m$ are arranged on a second substrate. The first and second substrates may be sealed together to form a discharge space therebetween, and the scan electrodes $Y_1$ to $Y_n$ and the sustain electrodes $X_1$ to $X_n$ may be substantially orthogonal to the address electrodes $A_1$ to $A_m$. A portion of the discharge space at an intersection of an address electrode and a scan and sustain electrode pair forms a discharge cell.

The controller 200 receives an image signal and outputs an address driving control signal, a sustain electrode driving control signal, and a scan electrode driving control signal. The controller may divided a frame into a plurality of subfields, and each subfield may have a reset period, an address period, and a sustain period.

The address driver 300 receives the address driving control signal from the controller 200 and applies a display data signal for selecting a discharge cell to be displayed to the respective address electrodes $A_1$ to $A_m$. The X electrode driver 400 receives the sustain electrode driving control signal from the controller 200 and applies a driving voltage to the sustain electrodes $X_1$ to $X_n$, and the Y electrode driver 500 receives the scan electrode driving control signal from the controller 200 and applies the driving signal to the scan electrodes $Y_1$ to $Y_n$.

Driving waveforms that may be applied to the address electrodes $A_1$ to $A_m$, the sustain electrodes $X_1$ to $X_n$, and the scan electrodes $Y_1$ to $Y_n$ in a subfield will be described with reference to FIG. 2 and FIG. 3. It will be described with reference to a discharge cell formed by an address electrode A, a sustain electrode X, and a scan electrode Y.

Figure 2:
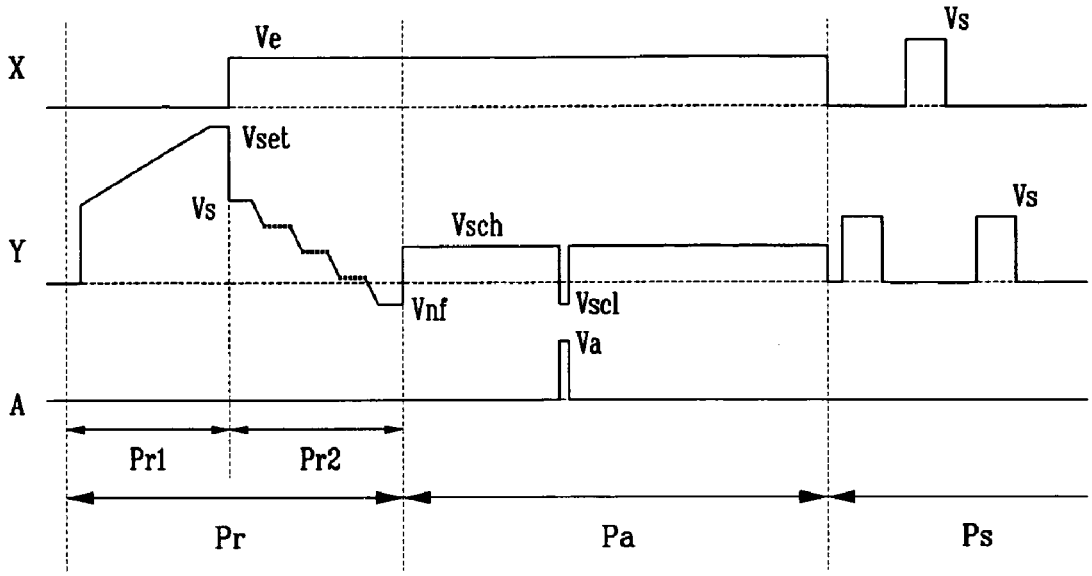
FIG. 2 shows driving waveforms of a PDP according to exemplary embodiments of the present invention.
Figure 3:
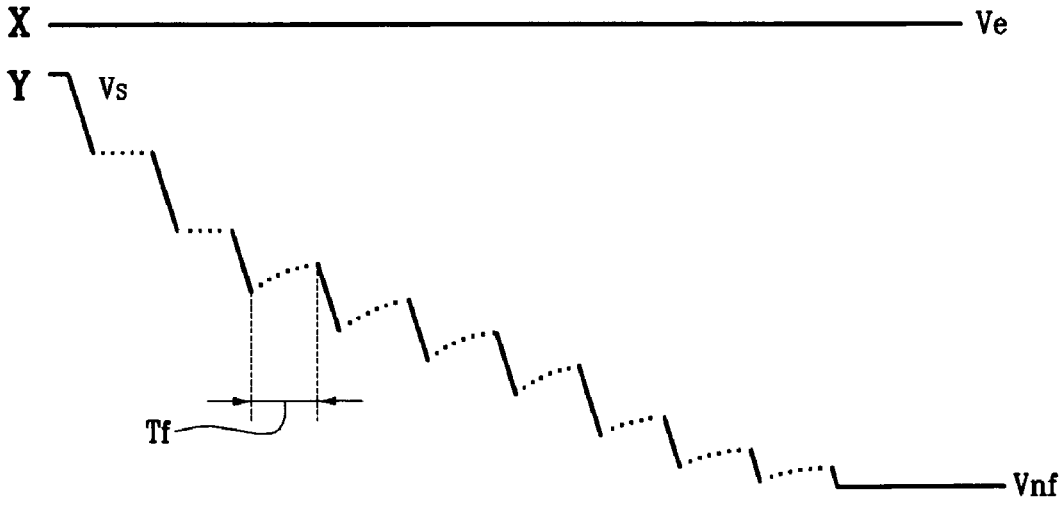
FIG. 3 shows a driving waveform of a PDP according to a first exemplary embodiment of the present invention.

FIG. 2 shows driving waveforms of a PDP according to exemplary embodiments of the present invention, and FIG. 3 shows a driving waveform of a PDP according to a first exemplary embodiment of the present invention.

As FIG. 2 shows, a subfield may include a reset period $P_r$, an address period $P_a$, and a sustain period $P_s$. The reset period $P_r$ includes a rising period $P_{r1}$ and a falling period $P_{r2}$.

Positive wall charges may be formed on the sustain electrode X and negative wall charges may be formed on the scan electrode Y when a final sustain discharge finishes in the sustain period $P_s$. A waveform gradually rising from a voltage of Vs to a voltage of Vset may be applied to the scan electrode Y, while biasing the sustain electrode X at 0V, in the rising period $P_{r1}$ of the reset period $P_r$. A weak reset discharge respectively occurs from the scan electrode Y to the address electrode A and the sustain electrode X, thereby accumulating negative wall charges on the scan electrode Y and positive wall charges on the address electrode A and the sustain electrode X.

A voltage at the scan electrode may be gradually reduced from the voltage of Vs to a voltage of Vnf, while biasing the sustain electrode at a voltage of Ve, in the falling period $P_{r2}$ of the reset period $P_r$. A weak reset discharge respectively occurs from the scan electrode Y to the address electrode A and the sustain electrode X, thereby accumulating negative wall charges on the scan electrode Y and erasing the positive wall charges accumulated on the address electrode A and the sustain electrode X to establish an appropriate wall charge state for a proper addressing operation.

In the address period $P_a$, a voltage of Vscl may be sequentially applied to the scan electrodes to select the scan electrode Y, and a voltage of Va may be applied to the address electrode corresponding to a discharge cell that is to be turned on among the discharge cells on the selected scan electrode Y. The voltages of Va and Vscl generate an address discharge in the corresponding discharge cell, thereby accumulating positive wall charges on the scan electrode Y and negative wall charges on the sustain electrode X. In the sustain period $P_s$, the voltage of Vs may be alternately applied to the scan electrode Y and the sustain electrode X, and the discharge cell in which the address discharge occurred is sustain-discharged.

As shown in FIG. 2 and FIG. 3, in the falling period $P_{r2}$ of the reset period $P_r$, while biasing the sustain electrode X at the voltage of Ve, a voltage applied to the scan electrode Y may be reduced by a predetermined voltage before floating the scan electrode Y by interrupting the voltage applied to it for a period of time $T_f$. The voltage at the scan electrode Y may be repeatedly reduced and floated.

When repeatedly performing the operation just described, a discharge occurs between the sustain electrode X and the scan electrode Y when a voltage difference between the scan electrode Y and the sustain electrode X exceeds a discharge firing voltage $V_f$. That is, a discharge current flows in the discharge space. Floating the scan electrode Y after the discharge occurs between the sustain electrode X and the scan electrode Y varies the voltage at the scan electrode Y according to the quantity of wall charges because no current flows from an external power. Accordingly, a variation of wall charges reduces a voltage in the discharge space, and the discharge may be eliminated by a lesser variation of wall charges. That is, the wall charges formed on the sustain electrode X and the scan electrode Y are reduced, the voltage in the discharge space may be steeply reduced, and an intensive discharge extinction may occur in the discharge space. A desirable amount of wall charges may be formed on the sustain electrode X and the scan electrode Y when repeatedly reducing the voltage at the scan electrode and floating the scan electrode Y.

The wall charges may be finely controlled because the lesser variation of wall charges may eliminate the discharge. A conventional ramp waveform may have a limited slope, which causes a longer reset period, because the voltage at the scan electrode is gradually reduced to control wall charges and prevent an intensive discharge. However, an intensive discharge extinction caused by a floating operation is used in the first exemplary embodiment of the present invention. Therefore, the voltage may be steeply reduced, and the reset period may be shortened.

A discharge may excessively occur if voltage is applied to the scan electrode for too long. Consequently, as FIG. 3 shows, the period for applying the voltage to the scan electrode, that is, a period for reducing the voltage at the scan electrode, is shorter than a period $T_f$ for floating the scan electrode.

The intensive discharge extinction by the floating operation will be described with reference to FIG. 4A, FIG. 4B, FIG. 4C, FIG. 4D and FIG. 4E. It will be described with reference to the sustain electrode and the scan electrode because the discharge occurs therebetween.

Figure 4A:
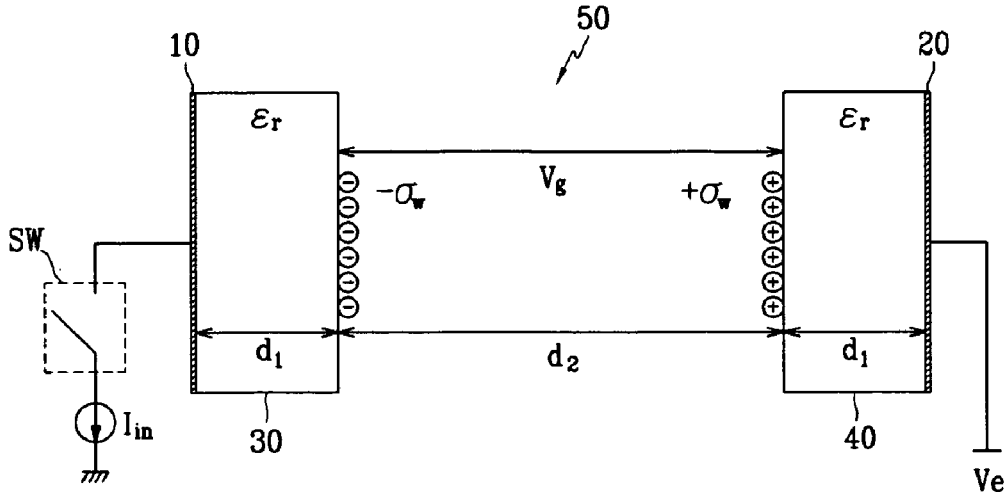
FIG. 4A is a diagram representing a discharge cell formed by a sustain electrode and a scan electrode.
Figure 4B:
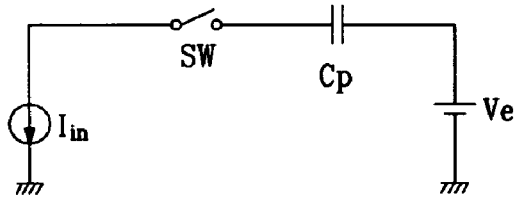
FIG. 4B is a diagram showing an equivalent circuit of FIG. 4A.
Figure 4C:
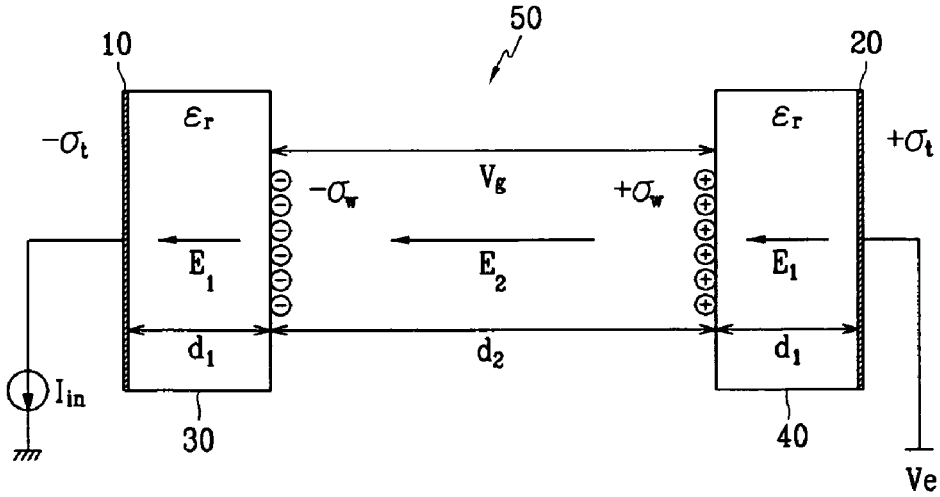
FIG. 4C is a diagram representing the discharge cell of FIG. 4A in which a discharge does not occur.
Figure 4D:
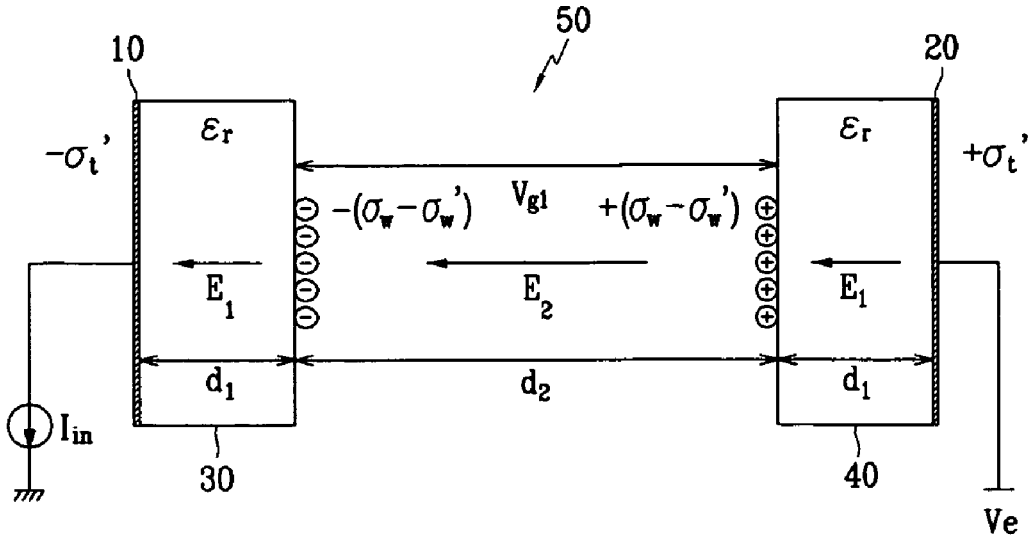
FIG. 4D is a diagram representing the discharge cell of FIG. 4A in which a voltage is applied when a discharge occurs.
Figure 4E:
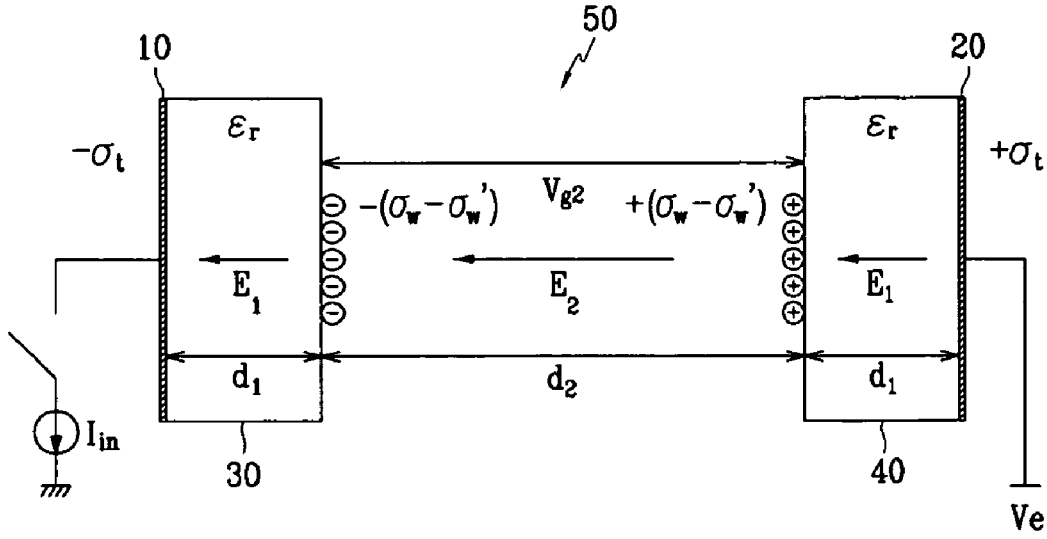
FIG. 4E is a diagram representing the discharge cell of FIG. 4A which is floated when a discharge occurs.

FIG. 4A is a diagram representing a discharge cell formed by a sustain electrode and a scan electrode, and FIG. 4B is a diagram showing an equivalent circuit of FIG. 4A. FIG. 4C is a diagram representing the discharge cell of FIG. 4A in which a discharge does not occur. FIG. 4D is a diagram representing the discharge cell of FIG. 4A in which a voltage is applied when a discharge occurs, and FIG. 4E is a diagram representing the discharge cell of FIG. 4A in which the scan electrode is floated when a discharge occurs. It is assumed, for convenience of description, that charges of $-\sigma_w$ and $+\sigma_w$ have been respectively formed on the scan electrode 10 and the sustain electrode 20 in FIG. 4A. While the charges are formed on a dielectric layer, it will be described that they are formed on electrodes for convenience of description.

As FIG. 4A shows, the scan electrode 10 is coupled to a current source $I_{in}$ through a switch SW, and the sustain electrode 20 is coupled to a voltage of Ve. Dielectric layers 30 and 40 are formed on the scan electrode 10 and the sustain electrode 20. An area between the dielectric layers 30 and 40 forms a discharge space 50, which is filled with a discharge gas.

Here, the scan electrode 10, the sustain electrode 20, the dielectric layers 30 and 40, and the discharge space 50 form a capacitance load. Accordingly, the capacitance load may be equivalently expressed as a panel capacitor Cp. A dielectric constant of the dielectric layers 30 and 40 is represented by $\in_r$, and Vg is a voltage at the discharge space 50. The dielectric layers 30 and 40 may have an equal thickness $d_1$, and $d_2$ is a distance between the dielectric layers 30 and 40 (a length of the discharge space).

When the switch SW is turned on, a voltage of Vy applied to the scan electrode 10 of the panel capacitor Cp decreases in proportion to time, as shown in Equation 1. While the voltage at the scan electrode 10 is reduced by using the current source in FIGS. 4A to 4E, the voltage at the scan electrode 10 may be reduced by discharging the panel capacitor, and a reduced voltage may be directly applied to the scan electrode 10.

$$V_y = V_y(0) - \frac{I_{in}}{C_p}t \qquad \text{[Equation 1]}$$

where $V_y(0)$ denotes a voltage $V_y$ at the scan electrode when the switch SW is turned on, and $C_p$ denotes a capacitance of the panel capacitor Cp.

The voltage of $V_g$ applied to the discharge space 50 when no discharge occurs while the switch is turned on may be calculated with reference to FIG. 4C. A voltage applied to the scan electrode 10 in FIG. 4C is assumed to be the voltage of $V_{in}$.

The charges of $-\sigma_w$ are applied to the scan electrode 10 and the charges of $+\sigma_w$ are applied to the sustain electrode 20 when the voltage of $V_{in}$ is applied to the scan electrode 10. At this time, electrical field $E_1$ in the dielectric layers 30 and 40 and an electrical field $E_2$ in the discharge space 50 is given as Equations 2 and 3 when applying the Gaussian theorem.

$$E_1 = \frac{\sigma_t}{\varepsilon_r \varepsilon_0} \qquad \text{[Equation 2]}$$

where $\sigma_t$ denotes a quantity of charges applied to the scan electrode and the sustain electrode, and $\in_0$ denotes a permittivity in the discharge space.

$$E_2 = \frac{\sigma_t + \sigma_w}{\varepsilon_0} \qquad \text{[Equation 3]}$$

An externally applied voltage of $(V_e - V_y)$ is given by a relation between a distance $d_2$ and an electric field as Equation 4, and the voltage of $V_g$ at the discharge space 50 is given as Equation 5.

$$2d_1E_1 + d_2E_2 = V_e - V_{in} \qquad \text{[Equation 4]}$$

$$V_g = d_2E_2 \qquad \text{[Equation 5]}$$

The charges of $\sigma_t$ applied to the scan electrode 10 and the sustain electrode 20 and the voltage of Vg in the discharge space 50 are respectively given as Equations 6 and 7 with reference to Equation 2 to Equation 5.

$$\sigma_t = \frac{V_e - V_{in} - \frac{d_2}{\varepsilon_0}\sigma_w}{\frac{d_2}{\varepsilon_0} + \frac{2d_1}{\varepsilon_r\varepsilon_0}} = \frac{V_e - V_{in} - V_w}{\frac{d_2}{\varepsilon_0} + \frac{2d_1}{\varepsilon_r\varepsilon_0}} \qquad \text{[Equation 6]}$$

where Vw denotes a voltage formed by wall charges $\sigma_w$ in the discharge space 50.

$$V_g = \frac{\varepsilon_r d_2}{\varepsilon_r d_2 + 2d_1}(V_e - V_{in} - V_w) + V_w = \alpha(V_e - V_{in}) + (1-\alpha)V_w \qquad \text{[Equation 7]}$$

At this time, $\alpha$ is near 1 because the length $d_2$ of the discharge space 50 is much greater than the thickness $d_1$ of the dielectric layers 30 and 40. That is, an externally applied voltage of (Ve−Vin) may be directly applied to the discharge space 50 as shown in Equation 7.

A voltage at the discharge space 50 when the wall charges on the scan electrode 10 and the sustain electrode 20 caused by the externally applied voltage of ($V_e$−$V_{in}$) are eliminated by $\sigma_w'$ will be calculated with reference to FIG. 4D. A quantity of charges applied to the scan electrode 10 and the sustain electrode 20 is increased by $\sigma_t'$ because charges are supplied from the power of $V_{in}$ in order to maintain a potential at electrodes when wall charges are formed in FIG. 4D.

The electric field $E_1$ in the dielectric layers 30 and 40 and the electric field $E_2$ in the discharge space are given as Equations 8 and 9 when applying the Gaussian theorem.

$$E_1 = \frac{\sigma_t'}{\varepsilon_r \varepsilon_0} \quad \text{[Equation 8]}$$

$$E_2 = \frac{\sigma_t' + \sigma_w - \sigma_w'}{\varepsilon_0} \quad \text{[Equation 9]}$$

From Equations 8 and 9, the quantity of charges applied to the scan electrode 10 and the sustain electrode 20 and a voltage of $V_{g1}$ in the discharge space are respectively given in Equations 10 and 11.

$$\sigma_t' = \frac{V_e - V_{in} - \frac{d_2}{\varepsilon_0}(\sigma_w - \sigma_w')}{\frac{d_2}{\varepsilon_0} + \frac{2d_1}{\varepsilon_r \varepsilon_0}} = \frac{V_e - V_{in} - V_w + \frac{d_2}{\varepsilon_0}\sigma_w'}{\frac{d_2}{\varepsilon_0} + \frac{2d_1}{\varepsilon_r \varepsilon_0}} \quad \text{[Equation 10]}$$

$$V_{g1} = d_2 E_2 = \alpha(V_e - V_{in}) + (1-\alpha)V_w - (1-\alpha)\frac{d_2}{\varepsilon_0}\sigma_w' \quad \text{[Equation 11]}$$

A lesser voltage reduction is generated in the discharge space 50 when the voltage of $V_{in}$ is externally applied and the discharge is generated because $\alpha$ is near 1 in Equation 11. Accordingly, discharge may be eliminated because the voltage of $V_{g1}$ in the discharge space decreases when the discharge erases a significant amount of wall charges.

A voltage of $V_{g2}$ in the discharge space is calculated with reference to FIG. 4E. Here, the voltage of $V_{g2}$ in the discharge space is a voltage when the switch SW is turned off (when the discharge space 50 is floated) after the wall charges formed on the scan electrode 10 and the sustain electrode 20 are eliminated by $\sigma_w'$ by the discharge caused by the voltage of Vin. The quantity of charges applied to the scan electrode 10 and the sustain electrode 20 is $\sigma_t$ in a like manner of FIG. 4C because charges are not externally supplied. Accordingly, the electric field $E_1$ in the dielectric layers 30 and 40 and the electric field $E_2$ in the discharge space 50 are respectively given as Equations 2 and 12 when applying the Gaussian theorem.

$$E_2 = \frac{\sigma_t + \sigma_w - \sigma_w'}{\varepsilon_0} \quad \text{[Equation 12]}$$

From Equation 12 and Equation 6, the voltage of $V_{g2}$ in the discharge space 50 is given as Equation 13.

$$V_{g2} = d_2 E_2 = \alpha(V_e - V_{in}) + (1-\alpha)V_w - \frac{d_2}{\varepsilon_0}\sigma_w' \quad \text{[Equation 13]}$$

As Equation 13 shows, the voltage may be significantly reduced by the eliminated wall charges when the switch SW is turned off (floated). That is, as shown in Equations 12 and 13, the voltage reduction caused by the wall charges when the electrode is floated may be $1/(1-\alpha)$ times greater than the voltage reduction caused by the wall charges when the voltage is applied. The voltage in the discharge space 50 may be steeply reduced although the wall charges are erased less when the switch SW is turned off, and therefore the discharge may be steeply eliminated because the voltage between the electrodes is below a discharge firing voltage. That is, floating the electrodes after a discharge starts functions as a steep quenching mechanism of the discharge. A voltage of $V_y$ at a floated scan electrode may increase by as much as a predetermined voltage as shown in FIG. 3 because the sustain electrode is biased at the voltage of $V_e$ when the voltage in the discharge space 50 is reduced.

As shown in FIG. 3, the scan electrode Y may be floated while the discharge is generated by reducing the voltage at the scan electrode, and the discharge may be eliminated while the wall charges formed on the scan electrode Y and the sustain electrode X are erased less by the discharge quenching mechanism. As this operation repeats, the wall charges may be properly controlled while the wall charges formed on the scan electrode Y and the sustain electrode X are eliminated little by little. That is, the wall charges may be controlled to a desired state in the falling period $P_{r2}$ of the reset period $P_r$.

The voltage at the scan electrode Y may be maintained at a final voltage Vnf for a predetermined period after reaching the final voltage Vnf in the falling period $P_{r2}$ of the reset period $P_r$. The final voltage maintaining period is a period for forming wall charges by a discharge, and a quantity of the wall charges on the scan electrode Y, the sustain electrode X, and the address electrode A varies according to a length of the final voltage maintaining period. Accordingly, if the final voltage maintaining period is longer or shorter than a predetermined period, a discharge may not be generated in a selected discharge cell or a misfiring discharge may be generated in an un-selected discharge cell.

The voltage at the scan electrode may increase when the scan electrode is floated after the discharge is generated by a voltage reduction of the scan electrode, and the discharge intensity determines the voltage increase. A time that the voltage at the scan electrode Y reaches the final voltage Vnf varies according to the amount of the voltage increase of the scan electrode after the scan electrode is floated when the amount of the voltage reduction of the scan electrode Y does not compensate for the increased voltage from the floating period in the waveform shown in FIG. 3. Accordingly, the final voltage maintaining period varies when the falling period $P_{r2}$ of the reset period $P_r$ is not established to be a predetermined period. Therefore, the misfiring discharge may be generated in the address period Pa, and the address discharge may not be generated in the discharge cell to be selected. An exemplary embodiment for establishing the final voltage maintaining period as a predetermined period will be described with reference to FIG. 5A and FIG. 5B.

Figure 5A:
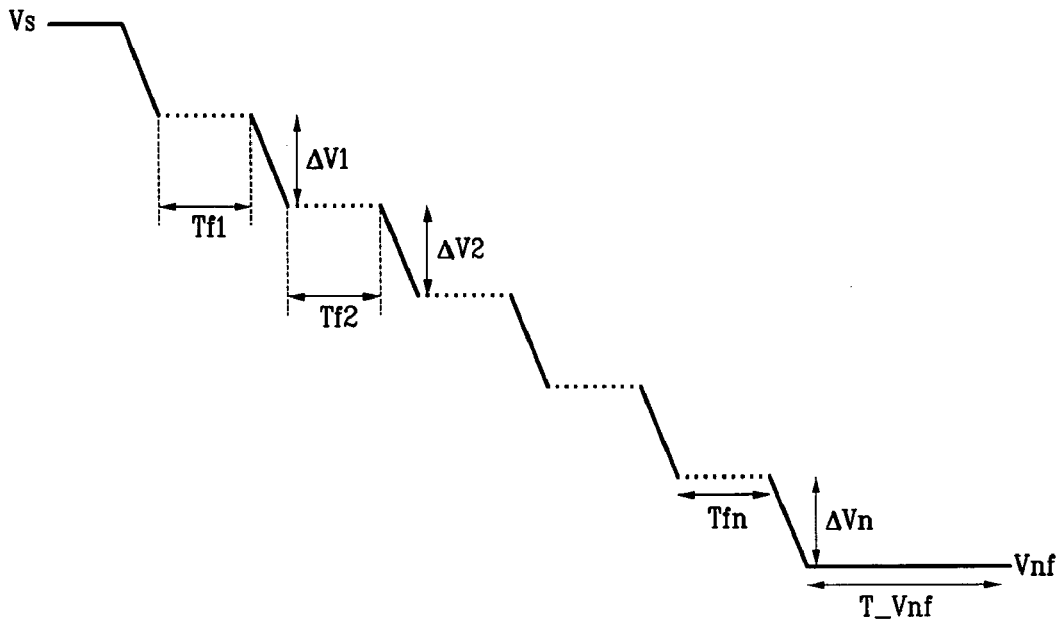
FIG. 5A and FIG. 5B show driving waveforms according to a second exemplary embodiment of the present invention.
Figure 5B:
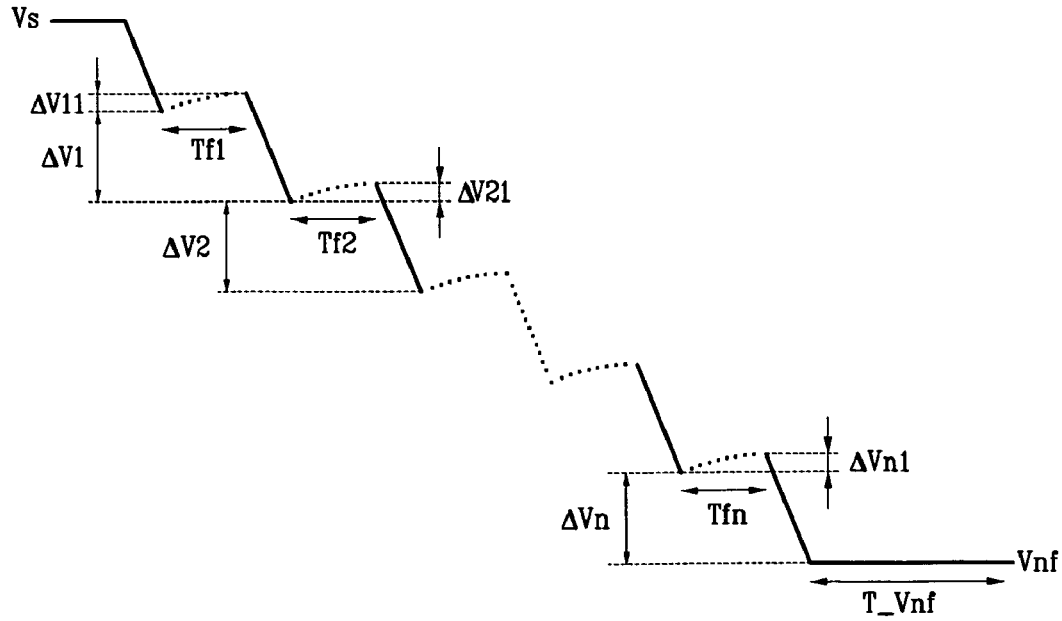

FIG. 5A and FIG. 5B show driving waveforms according to a second exemplary embodiment of the present invention.

According to the second exemplary embodiment of the present invention, the amount of the voltage reduction of the scan electrode Y is determined according to the voltage increase after the scan electrode is floated. As shown in FIG. 5A, the voltage reduction of the scan electrode Y is represented by ΔV1, ΔV2 . . . ΔVn when the scan electrode Y is repeatedly floated and reduced for an n number of times while no discharge is generated in the falling period $P_{r2}$ of the reset period $P_r$. As shown in FIG. 5B, a voltage at the scan electrode Y decreases by a voltage of (ΔV11+ΔV1) when the voltage at the scan electrode Y is increased by as much as ΔV11 by the discharge generated by the voltage reduction for a first floating period Tf1. A voltage at the scan electrode next decreases by a voltage of (ΔV21+ΔV2) when the voltage at the scan electrode Y is increased by as much as ΔV21 by the discharge generated by the voltage reduction for a second floating period Tf2. In like manner, a voltage at the scan electrode Y decreases by a voltage of (ΔVn1+ΔVn) when the voltage at the scan electrode Y is increased by as much as ΔVn1 by the discharge generated by a previous voltage reduction for an $n^{th}$ floating period Tfn. That is, the voltage may significantly decrease when the generated discharge causes a significant voltage increase in the floating period. The voltage may decrease less when the voltage increases less.

At this time, as the voltage at the scan electrode Y rapidly decreases by as much as ΔV11+ΔV1, ΔV21+ΔV2, . . . , ΔVn1+ΔVn, the period that the voltage at the scan electrode reaches to the final voltage may be established to be a predetermined period when the voltage at the scan electrode Y increases while the scan electrode is floated. Accordingly, the final voltage maintaining period T_Vnf of the scan electrode Y may be established to be a predetermined period.

While the falling period $P_{r2}$ of the reset period Pr has been described in the first and the second exemplary embodiments of the present invention, the present invention covers variations of the invention provided the wall charges are controlled by using a falling waveform. The present invention also covers variations of the invention provided the wall charges are controlled by using a rising waveform. Floating the scan electrode in the rising period $P_{r1}$ shown in FIG. 2 will be described with reference to FIGS. 6A and 6B.

Figure 6A:
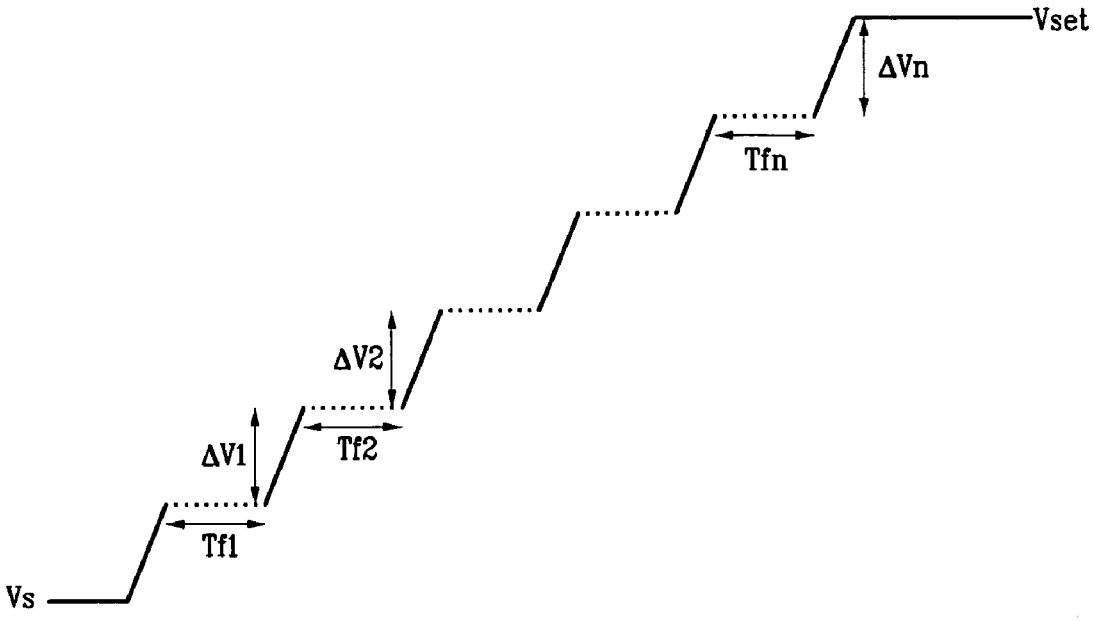
FIG. 6A and FIG. 6B show driving waveforms according to a third exemplary embodiment of the present invention.
Figure 6B:
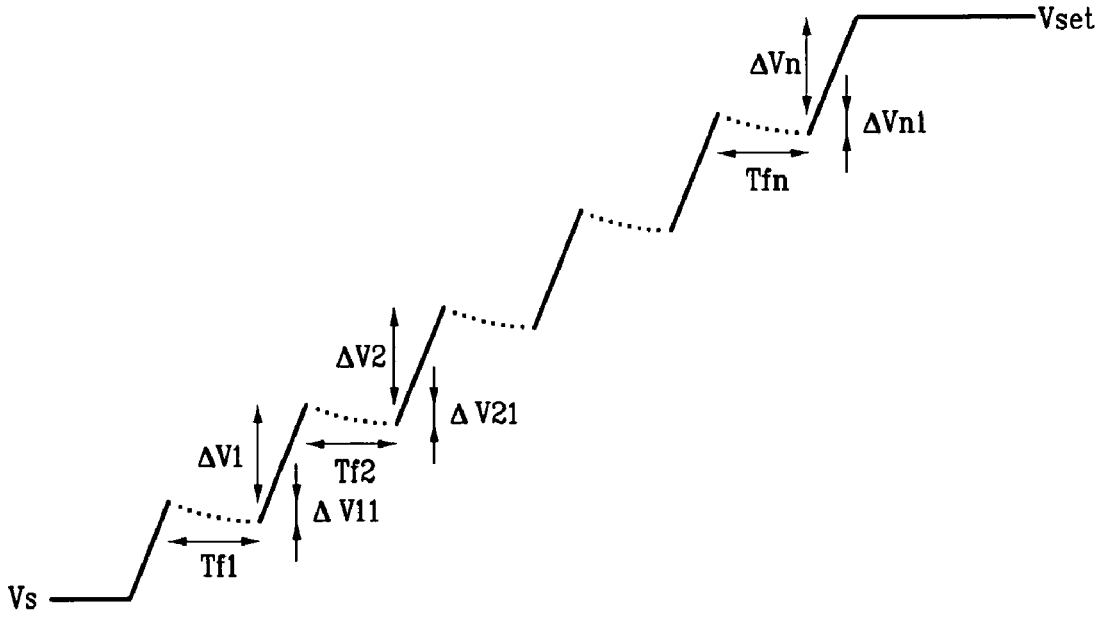

FIG. 6A and FIG. 6B show driving waveforms according to a third exemplary embodiment of the present invention.

As FIG. 6A and FIG. 6B show, a waveform in which the scan electrode is repeatedly floated may be applied to increase a voltage of the scan electrode Y from a voltage of Vs to a voltage of Vset in the rising period $P_{r1}$ of the reset period $P_r$. In this case, the sustain electrode X may be biased at 0V. That is, the voltage at the scan electrode Y is rapidly increased by as much as a predetermined voltage, a voltage supplied to the scan electrode Y is interrupted for a predetermined period, and the scan electrode Y is floated. The operation of increasing the voltage at the scan electrode Y by as much as the predetermined voltage and floating the scan electrode Y for the predetermined period is repeatedly performed.

A discharge is generated between the sustain electrode X and the scan electrode Y when a voltage difference between them exceeds the discharge firing voltage while the above operation is repeatedly performed. An intensive discharge extinction may be generated in the discharge space because the voltage in the discharge space may be steeply reduced as described above when the scan electrode Y is floated after the discharge starts between the sustain electrode X and the scan electrode Y. Positive (+) wall charges are formed on the sustain electrode X and negative wall charges (−) are formed on the scan electrode Y by the discharge between the sustain electrode X and the scan electrode Y. At this time, the voltage at the floated scan electrode may decrease because the voltage in the discharge space decreases.

The discharge is generated by increasing the voltage at the scan electrode Y, the scan electrode is floated, and therefore the wall charges may be formed while the intensive discharge extinction is generated in the discharge space. A desired quantity of the wall charges may be formed between the sustain electrode X and the scan electrode Y when the operation is repeatedly performed for a predetermined number of times.

The voltage at the scan electrode Y may be maintained at the final voltage $V_{set}$ for a predetermined period after the voltage at the scan electrode Y reaches the final voltage $V_{set}$ in the rising period $P_{r1}$ of the reset period $P_r$. That is, the wall voltage between the scan electrode Y and the address electrode A varies when the final voltage maintaining period is different (i.e. longer or shorter) from a predetermined period. Accordingly, the voltage increase of the scan electrode Y is determined according to the voltage reduction caused by the floating operation as shown in FIG. 6B.

For example, the voltage increase of the scan electrode Y is represented by ΔV1, ΔV2 . . . ΔVn when the operation of floating the scan electrode Y and increasing the voltage at the scan electrode is performed for an n number of times while no discharge is generated, as shown in FIG. 6A. As FIG. 6B shows, a voltage of the scan electrode Y may increase by a voltage of (ΔV11+ΔV1) when the voltage at the scan electrode Y decreases by as much as ΔV11 for a first floating period Tf1 due to a previous discharge. A voltage of the scan electrode Y may next increase by a voltage of (ΔV21+ΔV2) when the voltage at the scan electrode Y decreases by as much as ΔV21 during a second floating period Tf2 due to the discharge generated by the voltage increase. Similarly, a voltage of the scan electrode Y may increase by a voltage of (ΔVn1+ΔVn) when the voltage at the scan electrode Y decreases by as much as ΔVn1 due to a discharge generated by a voltage increase for an $n^{th}$ floating period Tfn. That is, the voltage may significantly increase when the generated discharge causes a significant voltage reduction in the floating period. The voltage may increase less when the voltage decreases less.

At this time, as the voltage at the scan electrode Y rapidly increases by as much as ΔV11+ΔV1, ΔV21+ΔV2, . . . , ΔVn1+ΔVn, the period that the voltage at the scan electrode reaches to the final voltage $V_{set}$ may be established to be a predetermined period when the voltage at the scan electrode Y decreases while the scan electrode is floated. Accordingly, the final voltage maintaining period of the scan electrode Y may be established to be a predetermined period.

A driving circuit for generating the waveforms described in FIG. 5A, FIG. 5B, FIG. 6A, and FIG. 6B according to the second and the third exemplary embodiments will be described with reference to FIG. 7 and FIG. 8. The driving circuit may be formed in the scan electrode driver 500 of FIG. 1.

Figure 7:
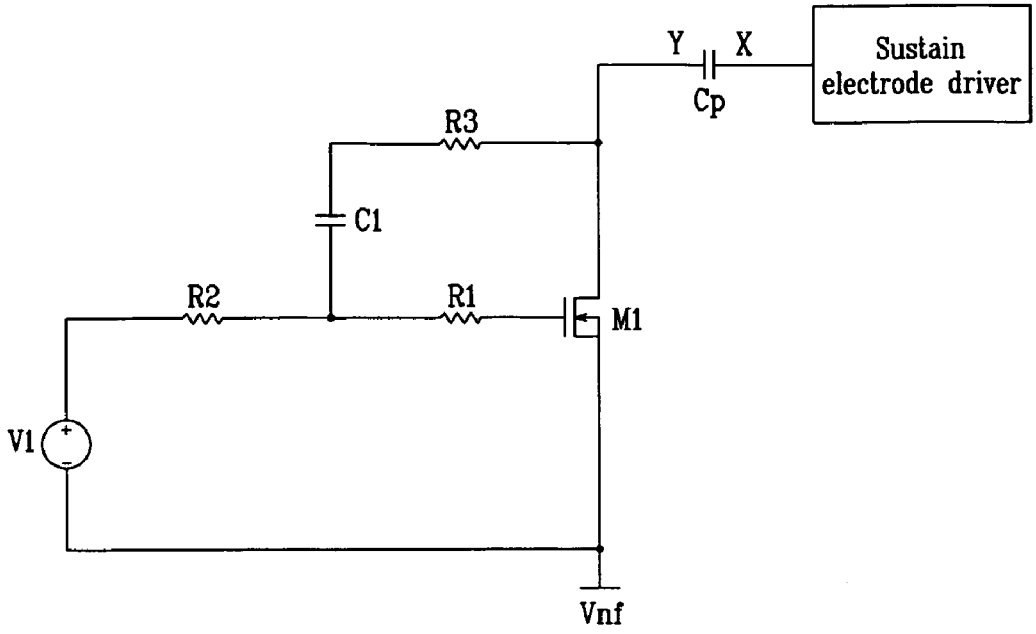
FIG. 7 and FIG. 8 are schematic circuit diagrams showing driving circuits according to fourth and fifth exemplary embodiments of the present invention, respectively.

FIG. 7 is a schematic circuit diagram showing a driving circuit, according to a fourth exemplary embodiment of the present invention, which may generate the driving waveforms of FIG. 5A and FIG. 5B. A panel capacitor Cp is a capacitance load formed between the scan electrode Y and the sustain electrode X, as described in FIG. 4A. A sustain electrode driving circuit is coupled to the sustain electrode X, which forms a second terminal of the panel capacitor Cp. It is assumed that the panel capacitor Cp has been charged with a predetermined amount of charges.

As FIG. 7 shows, the driving circuit according to the fourth exemplary embodiment of the present invention may include a transistor M1, resistors R1, R2, and R3, a capacitor C1 and a controlling signal power source V1. The driving circuit may apply a gradually falling waveform, as shown in FIG. 5A and FIG. 5B, to the scan electrode Y in the falling period $P_{r2}$ of the reset period $P_r$. While the transistor M1 is illustrated as an n-channel field effect transistor in FIG. 7, any switch having a function corresponding to the transistor M1 may be substituted for the transistor M1.

A drain as a main terminal of the transistor M1 is coupled to the scan electrode Y, which is a first terminal of the panel capacitor Cp, and a source, as another main terminal of the transistor M1, may be coupled to a power of Vnf for supplying a voltage of Vnf. The voltage of Vnf may be less than a voltage at the scan electrode Y of the panel capacitor Cp. A positive electrode of the controlling signal power source V1 may be coupled to a gate, which is a controlling terminal of the transistor M1, through the resistors R1 and R2 to supply a controlling signal to the transistor M1. A negative electrode of the controlling signal power source V1 may be coupled to the source of the transistor M1. The controlling signal may alternate between a high level voltage and a low level voltage. The resistors R1 and R2 are coupled in series. The capacitor C1 and the resistor R3 are coupled in series between the scan electrode of the panel capacitor Cp and a node of the resistors R1 and R2, and an order of coupling the capacitor C1 and the resistor R3 may be varied. A terminal coupled to the drain of transistor M1 will be referred to as a first terminal, and another terminal coupled to the source of the transistor M1 will be referred to as a second terminal.

Operation of the driving circuit shown in FIG. 7 will now be described. A high level control signal is applied to the gate of the transistor M1 through the resistors R1 and R2 when the high level control signal is outputted from the controlling signal power source V1. The voltage at the gate of the transistor M1 increases, and the transistor M1 turns on when its gate-source voltage exceeds a threshold voltage. When the transistor M1 turns on, a voltage at the panel capacitor Cp, and a voltage at the capacitor C1, decrease in proportion to currents of the drain of the transistor M1. Since the high level controlling signal charges the capacitor C1, the gate-source voltage of the transistor M1 does not exceed a predetermined voltage. That is, the increase of the gate-source voltage of the transistor M1 is controlled by turning on the transistor M1, and therefore the gate-source voltage is not increased over a predetermined voltage. A voltage is not steeply reduced in the panel capacitor Cp, but it is reduced with a predetermined slope corresponding to the drain current of the transistor M1 because the drain current of the transistor M1 is also controlled when the gate-source voltage does not exceed the predetermined voltage.

When the controlling signal is at the low level, the gate-source voltage of the transistor M1 decreases, the transistor M1 turns off, and the scan electrode Y of the panel capacitor Cp is floated. When a discharge is not generated by the voltage reduction of the panel capacitor Cp, the voltage at the panel capacitor Cp does not change when the scan electrode Y is floated. When the controlling signal is at the high level, the voltage at the panel capacitor Cp decreases.

However, when the discharge is generated by the voltage reduction of the panel capacitor Cp, the voltage at the panel capacitor Cp increases when the scan electrode Y is floated. The voltage at the drain of the transistor M1 increases, and therefore a voltage at the first terminal of the capacitor C1 increases. However, the voltage at the first terminal of the capacitor C1 does not reach the voltage at the drain of the transistor M1 while the transistor M1 is turned off when the resistor R3 has a high resistance. Accordingly, when the controlling signal is at high level, the transistor M1 is turned on, the voltage at the panel capacitor Cp is reduced, and the voltage at the first terminal of the capacitor C1 is less than the voltage at the drain of the transistor M1. The voltage at the capacitor C1 is not directly reduced because the voltage at the first terminal of the capacitor C1 is less than the voltage at the drain of the transistor M1 (i.e. the voltage at the scan electrode Y of the panel capacitor Cp) when the voltage at the panel capacitor Cp starts decreasing. Accordingly, the gate-source voltage of the transistor M1 increases because the capacitor is not required to be charged by the high level controlling signal, and therefore the drain current of the transistor M1 increases and the voltage at the panel capacitor Cp rapidly decreases.

Additionally, the voltage at the capacitor C1 is increased by the drain current of the transistor M1 when the voltage at the drain of the transistor M1 corresponds to the voltage at the first terminal of the capacitor C1. The gate-source voltage of the transistor M1 does not exceed the predetermined voltage because the high level controlling signal is used for charging the capacitor C1. The drain current of the transistor M1 is controlled, as described above, and the voltage is not steeply reduced in the panel capacitor Cp, but is reduced with a predetermined slope corresponding to the drain current of the transistor M1. That is, the voltage is reduced similarly to when no discharge is generated after the voltage is steeply reduced when the voltage at the panel capacitor Cp increases during the floating operation. Accordingly, the voltage at the panel capacitor Cp after a period that the controlling signal is at high level corresponds to the voltage when no discharge is generated. That is, the capacitor C1 and the resistor R3 perform as a compensator for compensating as much as the voltage variation when the scan electrode Y varies by the discharge.

When the controlling signal is at the low level, the transistor M1 turns off and the scan electrode Y is floated. If the discharge is generated when the voltage at the scan electrode is reduced, the voltage at the scan electrode increases when the scan electrode is floated. On the other hand, the voltage at the scan electrode does not change when a discharge is not generated. The voltage increased during the floating operation is applied to the capacitor C1, and the voltage at the scan electrode decreases as much as the voltage increase when the transistor M1 turns on. Therefore, a time that the voltage at the scan electrode Y reaches the final voltage Vnf when the discharge is generated corresponds to a time that the voltage at the scan electrode Y reaches the final voltage Vnf when no discharge is generated. Accordingly, the final voltage maintaining period may be maintained to be a predetermined period regardless of whether the discharge is generated and how great the discharge is.

A driving circuit for generating the driving waveforms described in FIG. 6A and FIG. 6B according to the third exemplary embodiment will now be described with reference to FIG. 8.

Figure 8:
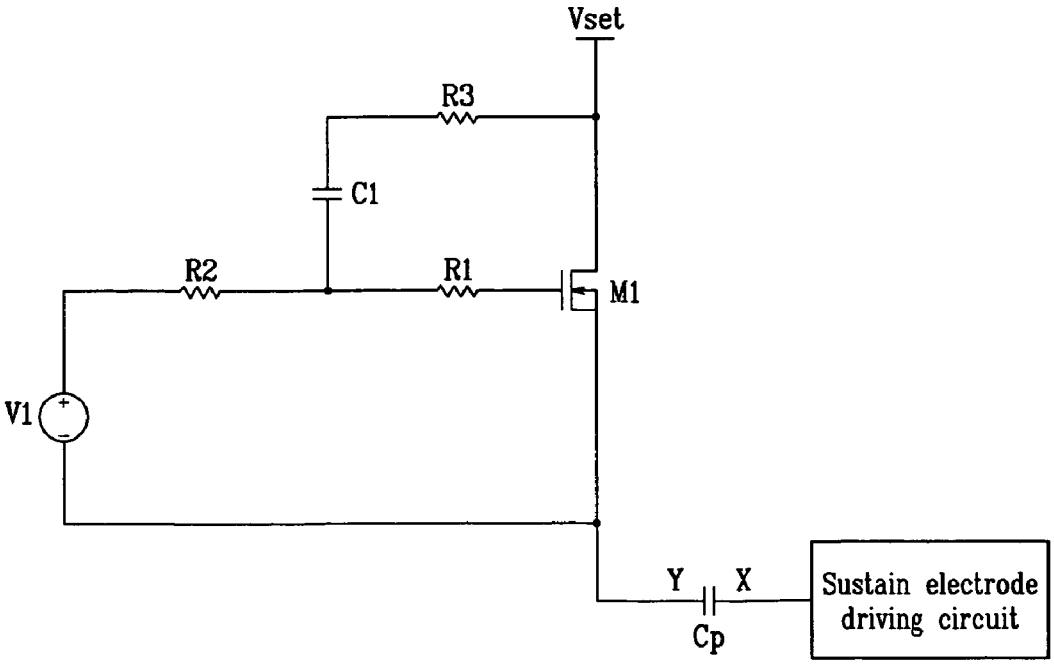

FIG. 8 is a schematic circuit diagram showing a driving circuit, according to a fifth exemplary embodiment of the present invention, which may generate the waveforms of FIG. 6A and FIG. 6B. A panel capacitor Cp is a capacitance load formed between the scan electrode Y and the sustain electrode X, as described in FIG. 4A. A sustain electrode driving circuit is coupled to the sustain electrode X as a second terminal of the panel capacitor Cp. It is assumed that the panel capacitor Cp has been charged with a predetermined amount of charges.

As FIG. 8 shows, the driving circuit according to the fifth exemplary embodiment of the present invention may have a configuration corresponding to the driving circuit of FIG. 7 except for a coupling of the transistor M1. The drain of the transistor M1 may be coupled to a power of Vset for supplying a voltage of Vset, and the source of the transistor M1 may be coupled to the scan electrode Y of the panel capacitor Cp. The voltage of Vset may be greater than the voltage at the scan electrode Y of the panel capacitor Cp. The driving circuit may apply a gradually rising waveform, as shown in FIG. 6A and FIG. 6B, to the scan electrode Y in the rising period $P_{r1}$ of the reset period $P_r$.

In the driving circuit of FIG. 8, the voltage of Vset increases the voltage at the scan electrode Y when the transistor M1 turns on, and the voltage at the scan electrode Y decreases when the discharge is generated by the voltage increase of the scan electrode Y and the transistor is turned off. That is, the voltage at the drain of the transistor M1 increases when the voltage at the scan electrode Y, which is a source voltage of the transistor M1, is a reference voltage, and therefore the voltage at the first terminal of the capacitor C1 is to be increased with reference to the voltage at the scan electrode Y. However, the voltage at the first terminal of the capacitor C1 is not sufficiently increased while the transistor M1 is turned off when the resistor R3 has a high resistance. Accordingly, the transistor M1 is turned on while the voltage at the first terminal of the capacitor C1, with reference to the source voltage of the transistor M1, is less than the voltage at the drain of the transistor M1, and the voltage at the panel capacitor Cp increases. As described with regard to FIG. 7, the voltage at the scan electrode Y may be steeply increased to a state that the voltage at the first terminal of the capacitor C1 corresponds to the voltage at the drain of the transistor M1, which is the voltage of Vset. When the discharge is generated, the voltage at the scan electrode Y is steeply increased to a state in which the discharge is not generated, and therefore the driving waveforms shown in FIG. 6A and FIG. 6B.

Operation of the driving circuit shown in FIG. 8 will be omitted because it corresponds to the operation of the driving circuit shown in FIG. 7.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

According to the present invention, the wall charges may be stably and quickly erased in the reset period, and the final voltage maintaining period of the falling waveform and the rising waveform may be maintained at a predetermined period regardless of the intensity of the discharge and whether the discharge is generated.

What is claimed is:

1. A method for driving a plasma display panel in which a capacitance load is formed by at least two electrodes during a reset period of a subfield comprising the reset period, an address period, and a sustain period, comprising:

biasing a second electrode at a voltage;

changing a voltage at a first electrode of the capacitance load by a first voltage;

floating the first electrode for a period of time; and changing the voltage at the first electrode by a second voltage, wherein the second voltage comprises the first voltage plus an amount of a voltage drift of the first electrode caused by floating the first electrode for the period of time, wherein an operation that the first electrode is floated and the voltage at the first electrode is changed by the second voltage is repeated for a number of times during the reset period of a single subfield to produce a stepped rising or falling ramp waveform, and wherein the first electrode is not floated when the voltage at the first electrode is changed by the first voltage and when the voltage at the first electrode is changed by the second voltage.

2. The method of claim 1, wherein the second voltage is greater when the first electrode is floated and the voltage at the first electrode changes than when the first electrode is floated and the voltage at the first electrode does not change.

3. The method of claim 2, wherein the second voltage is greater when the first electrode is floated and the voltage at the first electrode is changed by a third voltage than when the first electrode is floated and the voltage at the first electrode is changed by a voltage that is less than the third voltage.

4. The method of claim 2, wherein:

changing the voltage at the first electrode decreases the voltage at the first electrode, and floating the first electrode increases the voltage at the first electrode.

5. The method of claim 2, wherein changing the voltage at the first electrode increases the voltage at the first electrode, and floating the first electrode decreases the voltage at the first electrode.

6. A plasma display including a panel in which a capacitance load is formed by at least two electrodes and a driver for applying a biasing voltage to a second electrode of the capacitance load and a driving waveform to a first electrode of the capacitance load during a reset period of a subfield comprising the reset period, an address period, and a sustain period, the driver comprising:

a transistor for forming a current path between the first electrode and a first power source for supplying a first voltage when the transistor is turned on, the transistor being turned on in response to a first level of a control signal; and a voltage compensator for controlling the transistor, when a voltage drift of the first electrode occurs by floating the first electrode for a period of time by turn-off of the transistor, to change the voltage at the first electrode by the first voltage plus an amount of the voltage drift caused by floating the first electrode for the period of time when the transistor is turned on again, during the reset period of a single subfield, wherein the control signal alternately has the first level and a second level, an operation that the control signal alternately has the first level and the second level is repeated for a number of times during the reset period of the single subfield to produce a stepped rising or falling ramp waveform, and the transistor turns off in response to the second level.

7. The plasma display of claim 6, wherein the voltage compensator comprises a resistor and a capacitor coupled in series to each other and between a gate and a drain of the transistor.

8. The plasma display of claim 7, wherein the voltage drift is compensated by a voltage difference between a drain voltage of the transistor and a voltage at the capacitor with reference to a source voltage of the transistor when the transistor is turned off and the voltage at the first electrode is changed.

* * * * *

UNITED STATES PATENT AND TRADEMARK OFFICE

CERTIFICATE OF CORRECTION

PATENT NO. : 7,652,639 B2
APPLICATION NO. : 11/101593
DATED : January 26, 2010
INVENTOR(S) : Joo-Yul Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 699 days.

Signed and Sealed this

Twenty-third Day of November, 2010

David J. Kappos

David J. Kappos
*Director of the United States Patent and Trademark Office*